US007712449B1

(12) United States Patent
Schwoerer

(10) Patent No.: US 7,712,449 B1
(45) Date of Patent: May 11, 2010

(54) LOST MOTION VARIABLE VALVE ACTUATION SYSTEM FOR ENGINE BRAKING AND EARLY EXHAUST OPENING

(75) Inventor: John A. Schwoerer, Storrs, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 12/436,573

(22) Filed: May 6, 2009

(51) Int. Cl.
*F02D 13/04* (2006.01)

(52) U.S. Cl. ..... 123/321; 123/90.15; 123/90.16

(58) Field of Classification Search ..... 123/321, 123/322, 90.15–90.18
See application file for complete search history.

(56) References Cited

U.S. PATENT DOCUMENTS 5,829,397 A * 11/1998 Vorih et al. ..... 123/90.12
6,192,841 B1 * 2/2001 Vorih et al. ..... 123/90.12
6,374,784 B1 * 4/2002 Tischer et al. ..... 123/90.12
2003/0106532 A1 * 6/2003 Tian et al. ..... 123/446
2004/0103868 A1 * 6/2004 Engelberg ..... 123/90.12

* cited by examiner

*Primary Examiner*—Erick Solis
(74) *Attorney, Agent, or Firm*—David R. Yohannan; Kelley Drye & Warren LLP

(57) ABSTRACT

A method and system for actuating an internal combustion engine exhaust valve to provide compression release actuation during an engine braking mode of engine operation and early exhaust valve opening actuation during a positive power mode of engine operation is disclosed. The system may include a first cam having a compression release lobe and an early exhaust valve opening lobe connected to a hydraulic lost motion system including a first rocker arm. A hydraulically actuated piston may be selectively extended from the hydraulic lost motion system to provide the exhaust valve with compression release actuation or early exhaust valve opening actuation. The hydraulically actuated piston may be provided as a slave piston in a master-slave piston circuit in a fixed housing, or alternatively, as a hydraulic piston slidably disposed in a rocker arm. The method and system may further provide exhaust gas recirculation and/or brake gas recirculation in combination with compression release actuation and early exhaust valve opening actuation.

31 Claims, 12 Drawing Sheets

LOST MOTION VARIABLE VALVE ACTUATION SYSTEM FOR ENGINE BRAKING AND EARLY EXHAUST OPENING

FIELD OF THE INVENTION

The present invention relates generally to a system for actuating one or more engine valves in an internal combustion engine. In particular, the present invention relates to a lost motion system for providing variable valve actuation (VVA) for engine braking and early exhaust opening (EEO).

BACKGROUND OF THE INVENTION

Internal combustion engines typically use either a mechanical, electrical or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes, i.e., expansion, exhaust, intake, and compression. Both the intake and exhaust valves may be closed, and remain closed, during most of the expansion stroke, when the piston is traveling away from the cylinder head and the volume between the cylinder head and the piston head is increasing. During positive power operation, fuel is burned during the expansion stroke and positive power is delivered by the engine. The expansion stroke ends at the bottom dead center (BDC) point, at which time the piston reverses direction. The exhaust valve may be opened for a main exhaust event prior to BDC. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), brake gas recirculation (BGR), or other auxiliary intake and/or exhaust valve events.

With respect to auxiliary valve events, flow control of exhaust gas through an internal combustion engine has been used in order to provide vehicle engine braking. One or more exhaust valves may also be selectively opened to convert, at least temporarily, the engine into an air compressor for engine braking operation. This air compressor effect may be accomplished by either opening one or more exhaust valves near piston top dead center position for compression-release type braking, or by maintaining one or more exhaust valves in a relatively constant cracked open position during much or all of the piston motion, for bleeder type braking. In both types of braking, the engine may develop a retarding force that may be used to help slow a vehicle down. This braking force may provide the operator with increased control over the vehicle, and may also substantially reduce the wear on the service brakes. Compression-release type engine braking has been long known and is disclosed in Cummins, U.S. Pat. No. 3,220,392 (November 1965), which is hereby incorporated by reference.

Generally, engine braking systems may control the flow of exhaust gas to incorporate the principles of compression-release braking, bleeder braking, exhaust gas recirculation, and/or brake gas recirculation. During compression-release engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center position, at least one exhaust valve may be opened to release the compressed gases in the cylinder to the exhaust manifold, preventing the energy stored in the compressed gases from being returned to the engine on the subsequent expansion downstroke. In doing so, the engine may develop retarding power to help slow the vehicle down.

During bleeder engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression top dead center, i.e., early valve actuation, and then lift is held constant for a period of time. As such, a bleeder type engine brake may require lower force to actuate the valve(s) due to early valve actuation, and generate less noise due to continuous bleeding instead of the rapid blowdown of a compression-release type brake.

Exhaust gas recirculation (EGR) systems may allow a portion of the exhaust gases to flow back into the engine cylinder during positive power operation. EGR may be used to reduce the amount of NO created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s) and/or an intake valve(s).

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

Many different actuation systems may be used to selectively actuate engine valves to produce brake gas recirculation and compression-release events. One known type of actuation system is a lost motion system, described in the above-referenced Cummins patent. Another example of a lost motion system for variable valve actuation is disclosed in Vanderpoel, et al., U.S. Pat. No. 7,152,576 (Dec. 26, 2006), which is hereby incorporated by reference. An example of a system with primary and offset actuator rocker arms for engine valve actuation is disclosed in Janak, et al., U.S. Pub. No. 2006/0005796 (Jan. 12, 2006), which is hereby incorporated by reference.

In many internal combustion engines, the intake and exhaust valves may be actuated by fixed profile cams, and more specifically, by one or more fixed lobes or bumps that are an integral part of each cam. The cams may include a lobe for each valve event that the cam is responsible for providing. The size and shape of the lobes on the cam may dictate the valve lift and duration which result from the lobe. For example, an exhaust cam profile for a system may include a lobe for a brake gas recirculation event, a lobe for a compression-release event, and a lobe for a main exhaust event.

It may also be desirable to increase the exhaust back pressure in the exhaust manifold during engine braking. Higher exhaust back pressure may increase gas mass and pressure in the engine cylinder available for engine braking, and thereby increase braking power. Increased exhaust back pressure, however, may undesirably increase the force required to open the exhaust valve for a compression-release event because the opening force applied to the exhaust valve must exceed the increased pressure in the engine cylinder resulting from the increased exhaust back pressure. To some extent the increased exhaust back pressure may also increase the pressure applied to the back of the exhaust valve, which may counter-balance the increased pressure in the cylinder and thus reduce the loading on the exhaust valve opening mechanism used for the compression-release event.

Increasing the pressure of gases in the exhaust manifold may be accomplished by restricting the flow of gases through the exhaust manifold. Exhaust manifold restriction may be accomplished through the use of any structure that may, upon actuation, restrict all or partially all of the flow of exhaust gases through the exhaust manifold. The exhaust restrictor may be in the form of an exhaust engine brake, a turbocharger, a variable geometry turbocharger, a variable geometry turbocharger with a variable nozzle turbine, and/or any other device which may limit the flow of exhaust gases.

Exhaust brakes generally provide restriction by closing off all or part of the exhaust manifold or pipe, thereby preventing the exhaust gases from escaping. This restriction of the exhaust gases may provide a braking effect on the engine by providing a back pressure when each cylinder is on the exhaust stroke. For example, Meneely, U.S. Pat. No. 4,848,289 (Jul. 18, 1989); Schaefer, U.S. Pat. No. 6,109,027 (Aug. 29, 2000); Israel, U.S. Pat. No. 6,170,474 (Jan. 9, 2001); Kinerson et al., U.S. Pat. No. 6,179,096 (Jan. 30, 2001); and Anderson et al., U.S. Pat. Appl. Pub. No. US 2003/0019470 (Jan. 30, 2003) disclose exhaust brakes for use in retarding engines.

Turbochargers may similarly restrict exhaust gas flow from the exhaust manifold. Turbochargers often use the flow of high pressure exhaust gases from the exhaust manifold to power a turbine. A variable geometry turbocharger (VGT) may alter the amount of the high pressure exhaust gases that it captures in order to drive a turbine. For example, Arnold et al., U.S. Pat. No. 6,269,642 (Aug. 7, 2001) discloses a variable geometry turbocharger where the amount of exhaust gas restricted is varied by modifying the angle and the length of the vanes in a turbine. An example of the use of a variable geometry turbocharger in connection with engine braking is disclosed in Faletti et al., U.S. Pat. No. 5,813,231 (Sep. 29, 1998), Faletti et al., U.S. Pat. No. 6,148,793 (Nov. 21, 2000), and Ruggiero et al., U.S. Pat. No. 6,866,017 (Mar. 15, 2005), which are hereby incorporated by reference.

Over the years there have been improvements to lost motion systems for engine braking and there continues to be a need for improvements as technology evolves and new problems are discovered. Improvements are needed for many reasons, including providing a mechanically-driven exhaust main event for cold start and failsafe modes, meeting loading limits, (e.g., cam Hertz stress), avoiding separation and impact loading between cams and rollers, avoiding bridge tilt, meeting exhaust valve seating velocity limits, and protecting against valve-piston contact. There is a risk of valve-piston contact in many electronically-controlled variable valve actuation (VVA) systems. For example, lost motion VVA systems that provide early valve opening and spill oil near peak lifts have an increased risk of valve piston contact if the spill does not function, which may occur, for example, due to a clogged spill port or a broken valve spring. The valve/cam lift ratio of a rocker-actuated VVA system is more limited by the valve-train layout than that of a master-slave system, where the valve/cam lift ratio is governed by hydraulic piston diameters.

SUMMARY OF THE INVENTION

Responsive to the foregoing challenges, Applicant has developed an innovative system for actuating an internal combustion engine exhaust valve to provide compression release actuation during an engine braking mode of engine operation and early exhaust valve opening actuation during a positive power mode of engine operation, said system comprising: a first cam having a compression release lobe, an early exhaust valve opening lobe, and optionally a BGR lobe; a hydraulic lost motion system operatively contacting said first cam, said hydraulic lost motion system including a first rocker arm; a hydraulically actuated piston extending from said hydraulic lost motion system, said hydraulically actuated piston adapted to provide said exhaust valve with compression release actuation during an engine braking mode of engine operation and early exhaust valve opening actuation during a positive power mode of operation; a second cam having a main exhaust lobe; and a main exhaust rocker arm operatively contacting said second cam and adapted to provide a main exhaust actuation to said exhaust valve.

Applicant has further developed an innovative system for actuating an internal combustion engine exhaust valve comprising: a first means for imparting motion for a compression release engine braking actuation optionally including BGR actuation, and an early exhaust valve opening actuation; a hydraulic lost motion system operatively contacting said first means for imparting motion, said hydraulic lost motion system including a first rocker arm; a hydraulically actuated piston extending from said hydraulic lost motion system, said hydraulically actuated piston adapted to selectively provide said exhaust valve with compression release engine braking actuation and early exhaust valve opening actuation; a second means for imparting motion for a main exhaust actuation; a main exhaust rocker arm operatively contacting said second means for imparting motion; and means for controlling said hydraulic lost motion system to selectively provide the compression release engine braking actuation and the early exhaust valve opening actuation.

Applicant has further developed an innovative method of actuating an internal combustion engine exhaust valve to selectively provide compression release engine braking actuation and early exhaust valve opening actuation using a cam with a compression release engine braking lobe and a early exhaust valve opening lobe, and with optional BGR actuation, said method comprising: imparting compression release engine braking actuation motion and early exhaust valve opening actuation motion from said cam to a hydraulic lost motion system including a first rocker arm; determining whether the internal combustion engine is in an engine braking mode of operation; selectively hydraulically locking and unlocking a hydraulically actuated piston in said hydraulic lost motion system to provide said exhaust valve with compression release engine braking actuation when the internal combustion engine is in the engine braking mode of operation; determining whether the internal combustion engine is in a positive power mode of operation and early exhaust valve opening is desired; and selectively hydraulically locking and unlocking the hydraulically actuated piston in said hydraulic lost motion system to provide said exhaust valve with early exhaust valve opening actuation when the internal combustion engine is in the positive power mode of operation and early exhaust valve opening is desired.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to embodiments of the present invention, examples of which are illustrated in the accompanying drawings. Embodiments of the present invention may be used to provide variable valve actuation for compression-release engine braking and brake gas recirculation during an engine braking mode of engine operation, as well as early exhaust valve opening during a positive power mode of engine operation.

Figure 1:
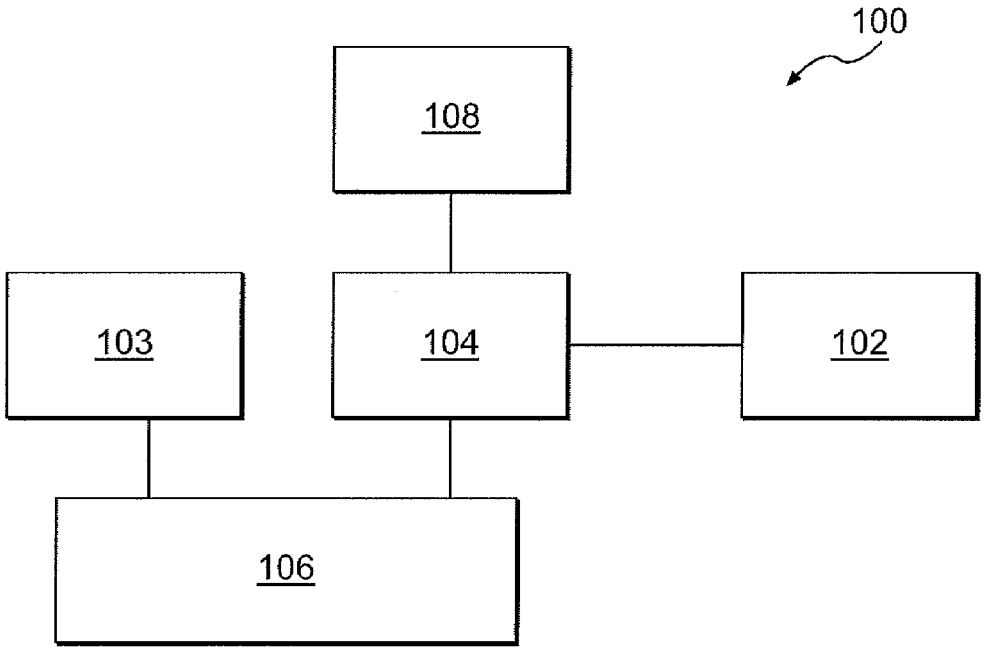
FIG. 1 is a schematic block diagram illustrating a valve actuation system in accordance with an embodiment of the present invention.

FIG. 1 is a block diagram that illustrates a valve actuation system 100 in accordance with a first embodiment of the present invention. The valve actuation system 100 may include a first motion imparting means 102, such as a cam with one or more lobes or bumps, operatively contacting a lost motion system 104, which in turn may be operatively connected to one or more engine valves 106. The valve actuation system may further include a second motion imparting means 103 operatively connected to the one or more engine valves 106. It is appreciated that any number of valve train elements, such as push tubes, rocker arms, and or valve bridges may be provided between or as part of the first and second motion imparting means 102 and 103, the lost motion system 104, and the engine valves 106, without departing from the intended scope of the present invention. The first motion imparting means 102 may preferably include both a early exhaust valve opening lobe or bump, a compression release lobe or bump, and optionally a BGR lobe or bump, which may provide input motion to the lost motion system 104. The motion selectively transferred to the engine valves 106 by the lost motion system 104 may be used to produce various valve actuation events, such as, but not limited to, a compression release braking event, a bleeder braking event, an exhaust gas recirculation event, a brake gas recirculation event, an early exhaust valve opening event, an early intake valve closing event, and/or a centered lift valve event. Preferably, the lost motion system 104 may be switched on or off to selectively transfer either no motion, compression release motion or early exhaust valve opening motion to the engine valves 106 by a controller 108. The second motion imparting means 103 may also provide valve actuation events, such as a main exhaust event. The engine valves 106 may be exhaust valves, intake valves, or auxiliary valves. The first motion imparting means 102 and the second motion imparting means 103 may actuate the engine valves 106 independently of each other.

The first motion imparting means 102 may comprise any combination of cams, push tubes, and/or rocker arms or their equivalents. The lost motion system 104 may comprise any structure that connects the motion imparting means 102 to the engine valves 106 and selectively transfers motion from the motion imparting means 102 to the engine valves 106. In one sense, the lost motion system 104 may be any structure capable of selectively attaining more than one fixed length. For example, the lost motion system 104 may comprise a mechanical linkage, a hydraulic circuit, a hydro-mechanical linkage, an electromechanical linkage and/or any other linkage adapted to connect to the motion imparting means 102 to the engine valves 106 and attain more than one operative length. When the lost motion system 104 incorporates a hydraulic circuit, the lost motion system 104 may include pressure-adjusting means to adjust the pressure or amount of fluid in a circuit, such as, for example, trigger valves, check valves, accumulator, and/or other devices for releasing hydraulic fluid from or adding hydraulic fluid to the circuit. The lost motion system 104 may be located at any point in the valve train connecting the motion imparting means 102 with the engine valves 106.

The controller 108 may comprise any electronic, mechanical, or hydraulic device for communicating with and controlling the lost motion system 104. The controller 108 may include a microprocessor, which is linked to other engine components, to determine and select the appropriate instantaneous length of the lost motion system 104. Valve actuation may be optimized at a plurality of engine speeds and conditions by controlling the instantaneous length of the lost motion system 104 based upon information collected by the microprocessor from engine components. Preferably, the controller 108 may be adapted to operate the lost motion system 104 at high speed (i.e., one or more times per engine cycle) using a high speed hydraulic trigger valve.

Figure 2:
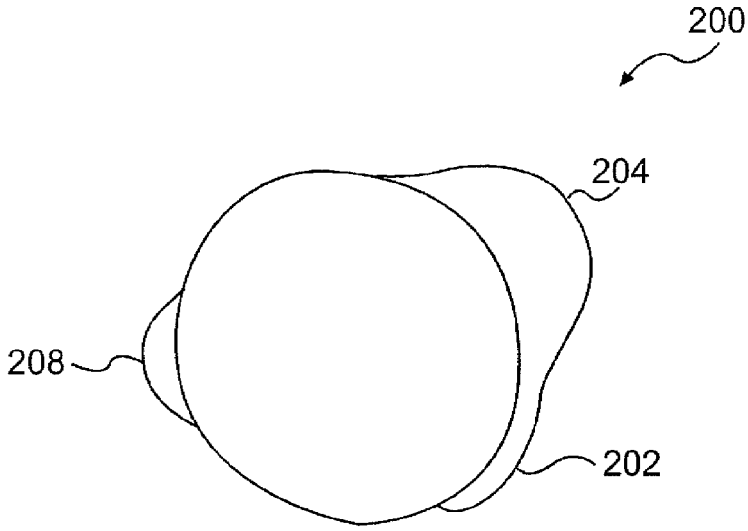
FIG. 2 is a side view of a motion imparting means or cam in accordance with an exemplary embodiment of the present invention.

FIG. 2 is a schematic diagram of a cam 200 which may serve as all or part of the motion imparting means 102. The motion imparting means 102 of FIG. 1 may comprise the cam 200, a rocker arm, and/or a push tube. The cam 200 may include one or more lobes corresponding to various valve actuation events, such as a compression release lobe 202, an early exhaust valve opening lobe 204, and a brake gas recirculation lobe 208. The depictions (e.g., number, size, shape, location) of the lobes on the cam 200 are intended to be illustrative only and not limiting. Several embodiments of the invention contemplate using separate cams for the main valve opening event (i.e., main exhaust or main intake) and the auxiliary valve opening events such as compression release, early valve opening, and/or brake gas recirculation.

Figure 3:
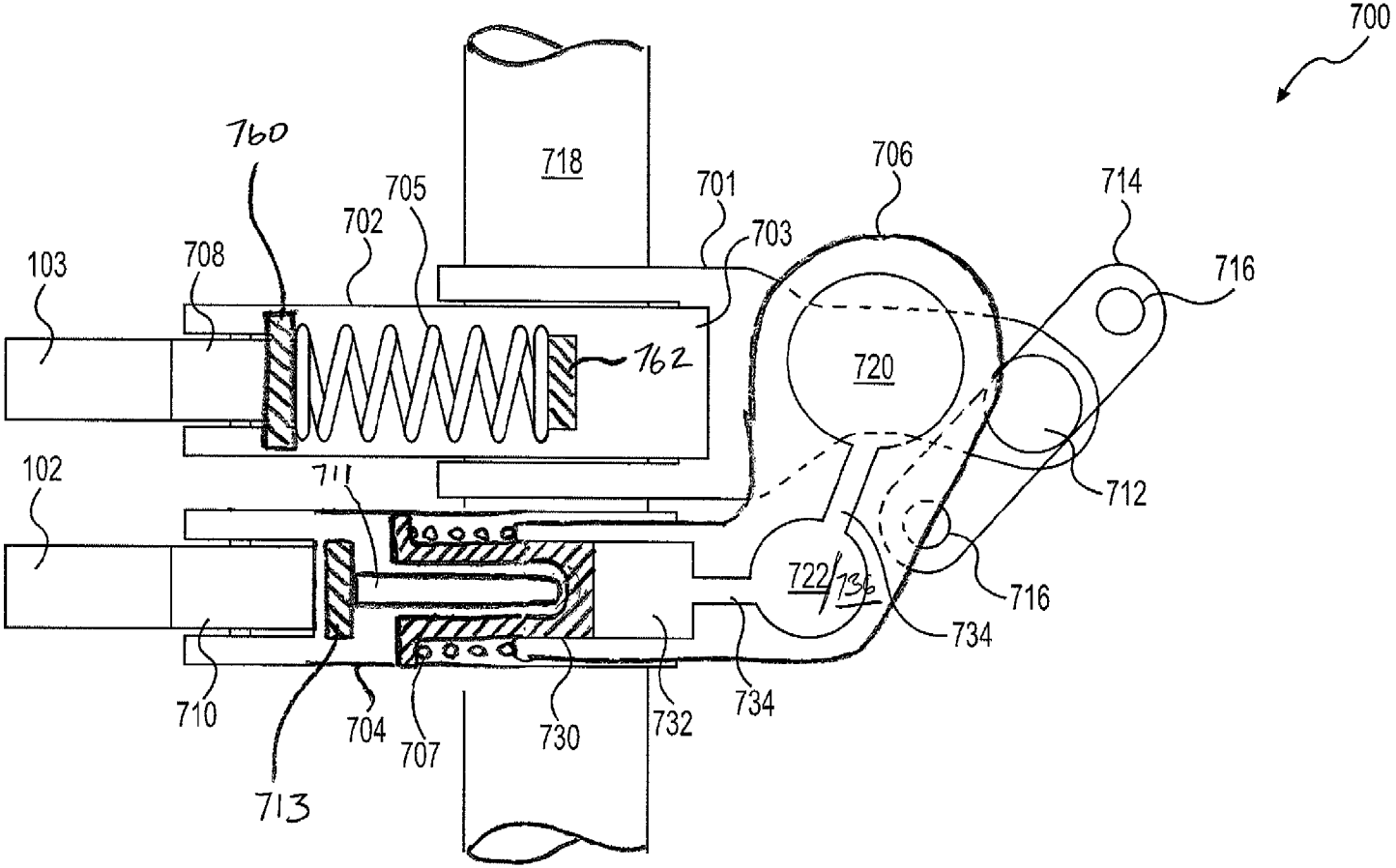
FIG. 3 is a schematic top view in partial cross-section of a variable valve actuation system including two half rocker arms and a lost motion system housing in accordance with an embodiment of the present invention.

FIG. 3 is a schematic top view in partial cross section of variable valve actuation system 700 in accordance with a second embodiment of the present invention. The variable valve actuation system 700 may include first and second valve train assemblies extending between the first and second motion imparting means, 102 and 103, respectively, and the exhaust valves 716. The first valve train assembly may include a first half (or main exhaust) rocker arm 701 pivotally mounted on a rocker shaft 718, and a second half rocker arm 702 pivotally mounted on the rocker shaft directly behind the first half rocker arm which together comprise an articulated rocker arm. The first half rocker arm 701 may include an elephant foot or other valve bridge contacting portion 712 adapted to apply a valve actuation motion to the engine valves, preferably exhaust valves, 716 through a valve bridge 714.

The second half rocker arm 702 may include a valve end portion 703 adapted to apply a pivoting motion to the first half rocker arm 701 so as to actuate the exhaust valves 716. The second half rocker arm 702 may be biased towards the second motion imparting means 103 by a spring 705, which may create such bias force by pushing against a flange or contact surface 760 provided on the second half rocker arm from a fixed stop or flange 762 provided on a fixed engine part so that a cam roller 708 provided with the second half rocker arm remains in relatively constant contact with the second motion imparting means 103.

The second valve train assembly of the variable valve actuation system 700 may further include a third half rocker arm 704 pivotally mounted on the rocker shaft 718 adjacent to the first and second half rocker arms 701 and 702. The third half rocker arm 704 may be biased by a second spring 707 through a master piston 730 and a rod 711 that acts on a contact surface 713 provided on the third half rocker arm so that a second cam roller 710 provided with the third half rocker arm remains in relatively constant contact with the first motion imparting means 102. The rod 711 may include a contact surface to act on a master piston 730 which is slidably disposed in a master piston bore 732 provided in a lost motion system housing 706. Hydraulic fluid may be provided to the master piston bore 732. The lost motion system housing 706 may be fixed by bolts or other connection means to the internal combustion engine that includes the exhaust valves 716. The master piston bore 732 may be connected to a high-speed trigger valve 736 and optionally to an accumulator 722, and a slave piston 720 by a hydraulic fluid circuit or passages 734.

Figure 4:
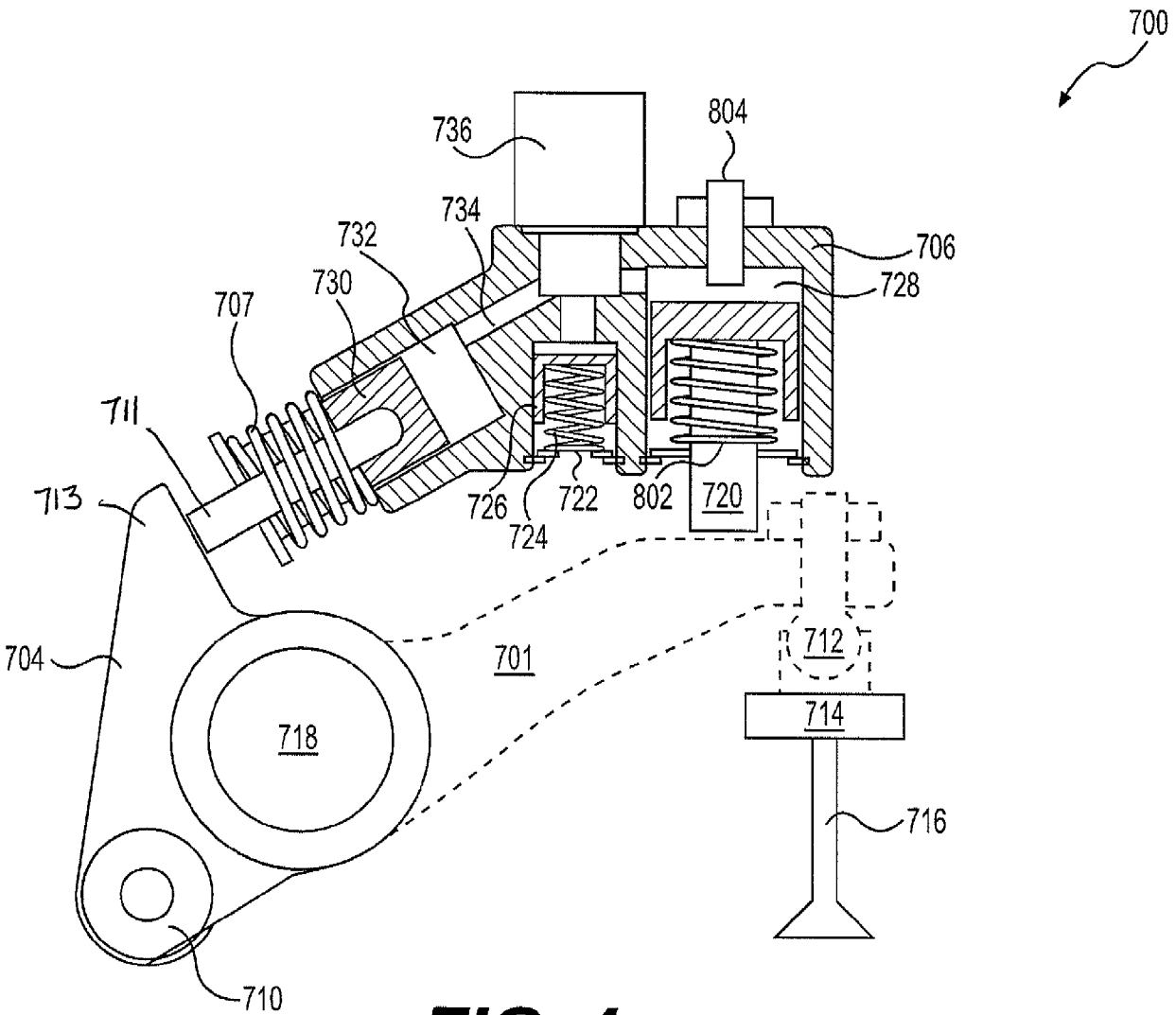
FIG. 4 is a schematic side view in partial cross-section of a first of the rocker arms and the lost motion system housing shown in FIG. 3.

The interaction of the third half rocker arm 704 and the lost motion system 706 are illustrated in FIG. 4. As shown in FIG. 4, a control valve or high-speed trigger valve 736 may be provided in the hydraulic circuit 734 such that it may control the supply of hydraulic fluid to and from the hydraulic circuit. Further, the accumulator 722 may include an accumulator piston 724 that biases an accumulator piston 726 into an accumulator bore. Similarly, a slave piston spring 802 may bias the slave piston 720 upward into the slave piston bore 728 towards an adjustable lash screw 804. With continued reference to FIGS. 3 and 4, when the trigger valve 736 is maintained closed, hydraulic fluid may be trapped in the hydraulic circuit 734 and prevented from flowing into or out of the accumulator 722, and conversely, when the trigger valve is maintained open, hydraulic fluid may flow freely out of the hydraulic circuit and into and out of the accumulator 722. When the first motion imparting means 102 (shown in FIG. 3) causes the third half rocker arm 704 to pivot about the rocker shaft 718, the contact surface on the third half rocker arm may push the master piston 730 into the master piston bore, which in turn may force the slave piston 720 downward and into contact with the first half rocker arm 701. In turn the half rocker arm 701 may act through the valve bridge 714 to actuate or open the exhaust valves 716. Use of a first motion imparting means 102, such as a cam with a compression release engine braking lobe, a early exhaust valve opening lobe, and/or a brake gas recirculation lobe, coupled with selective operation of the trigger valve 736 may enable selective provision of compression release engine braking and brake gas recirculation during an engine braking mode of engine operation and variable degrees of early exhaust valve opening during a positive power mode of engine operation.

Figure 5:
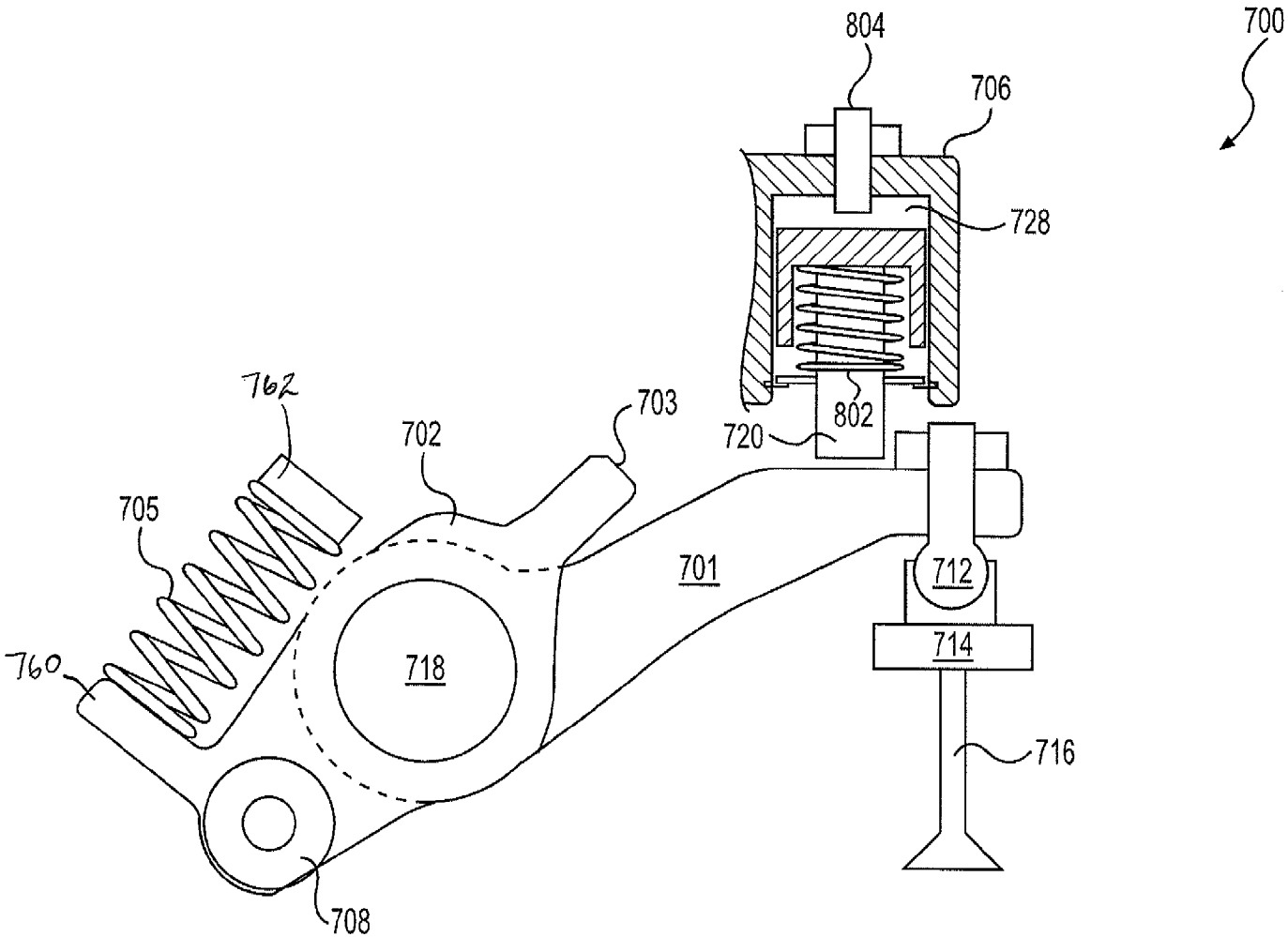
FIG. 5 is a schematic side view in partial cross-section of a second of the rocker arms and a portion of the lost motion system housing shown in FIG. 3.

The interaction of the first and second half rocker arms 701 and 702 with each other and the lost motion system 706 is illustrated in FIG. 5. As shown in FIG. 5, the spring 705 may bias the second half rocker arm 702 away from the first half rocker arm 701 and into contact with the second motion imparting means 103 (shown in FIG. 3) by acting on flange 760. Variations in the angle in which the spring 705 meets the flange 760 are contemplated to be within the scope of the present invention. For example, in some embodiments, the spring 705 may act almost directly downward on the second half rocker arm 702 over the cam roller 708 to save space by reducing the height of the spring-flange arrangement. When the second motion imparting means 103 provides a valve actuation motion, such as a main exhaust event actuation, to the second half rocker arm 702, the second half rocker arm may, in turn, act on the first half rocker arm 701 to actuate the exhaust valves 716 for a main exhaust event. Because the first half rocker arm 701 is free to pivot away from the second half rocker arm 702, the lost motion system 706 may also act on the first half rocker arm 701 to provide valve actuation events such as compression release engine braking, brake gas recirculation, and/or early exhaust valve opening independent of the pivoting of the second half rocker arm 702.

Figure 6:
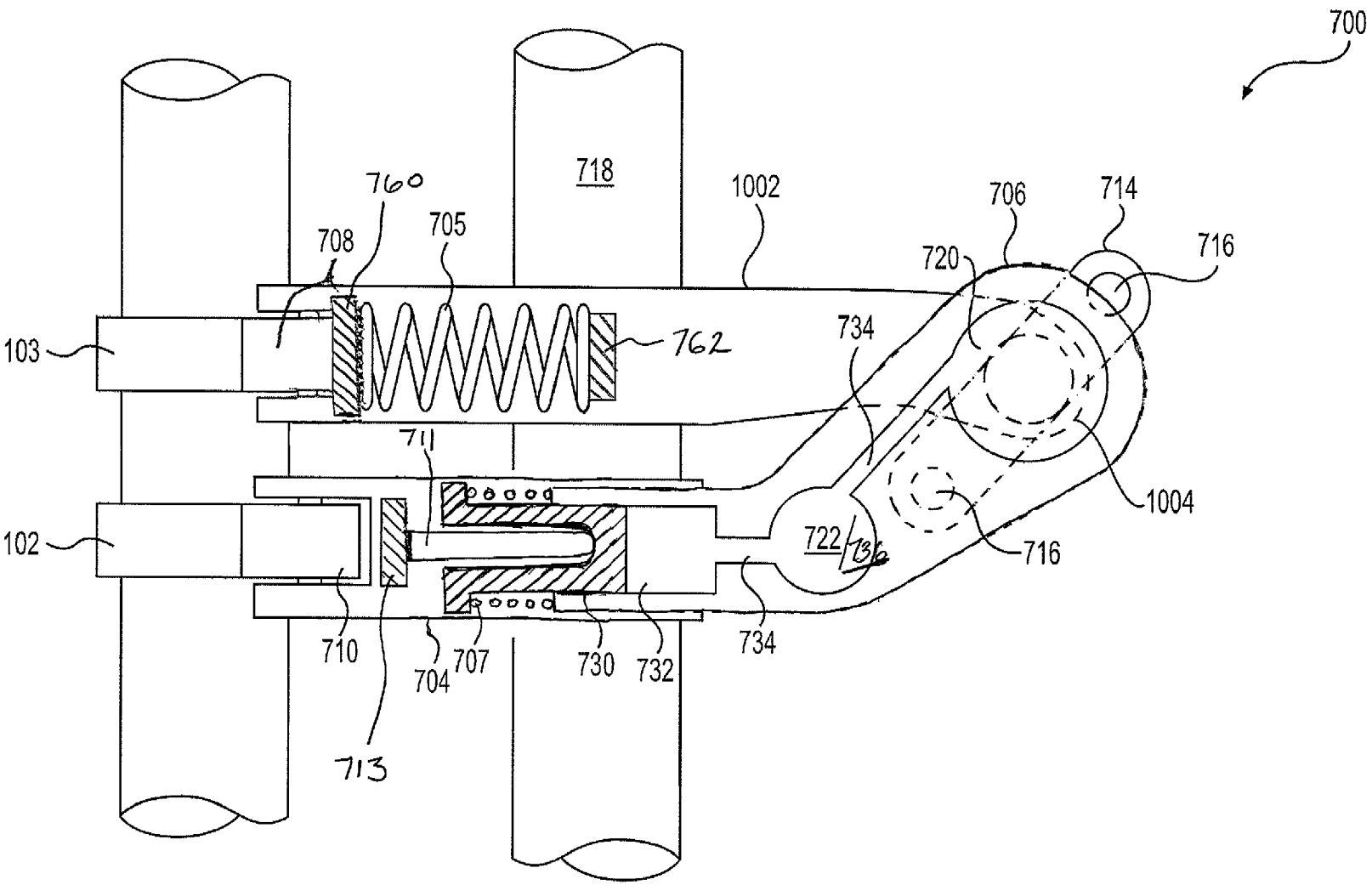
FIG. 6 is a schematic top view in partial cross-section of a variable valve actuation system including a half rocker arm and a full rocker arm and a lost motion system housing in accordance with an alternative embodiment of the present invention.

FIG. 6 is a schematic top view of a variable valve actuation system 700 in accordance with a third embodiment of the present invention, in which like reference characters refer to like elements. The first valve train assembly of the variable valve actuation system 700 may include a first (or main exhaust) rocker arm 1002 pivotally mounted on a rocker shaft 718. The first rocker arm 1002 may include a cam roller 708 biased by a spring 705 which acts by pushing from a fixed stop 762 against a contact surface 760 provided on the first rocker arm so that the cam roller is maintained in relatively constant contact with a second motion imparting means 103, such as a cam provided on a camshaft. The first rocker arm 1002 may include a valve actuation end 1004 adapted to contact and act on a valve bridge 714 which in turn may actuate engine valves such as exhaust valves 716.

The second valve train assembly of the variable valve actuation system 700 shown in FIG. 6 may further include a third half rocker arm 704 pivotally mounted on the rocker shaft 718 adjacent to the first rocker arm 1002. The third half rocker arm 704 and the lost motion system 706 may include the same elements as the variable valve actuation system described in connection with FIGS. 3-5 above, save for the design of the slave piston 720.

Figure 7:
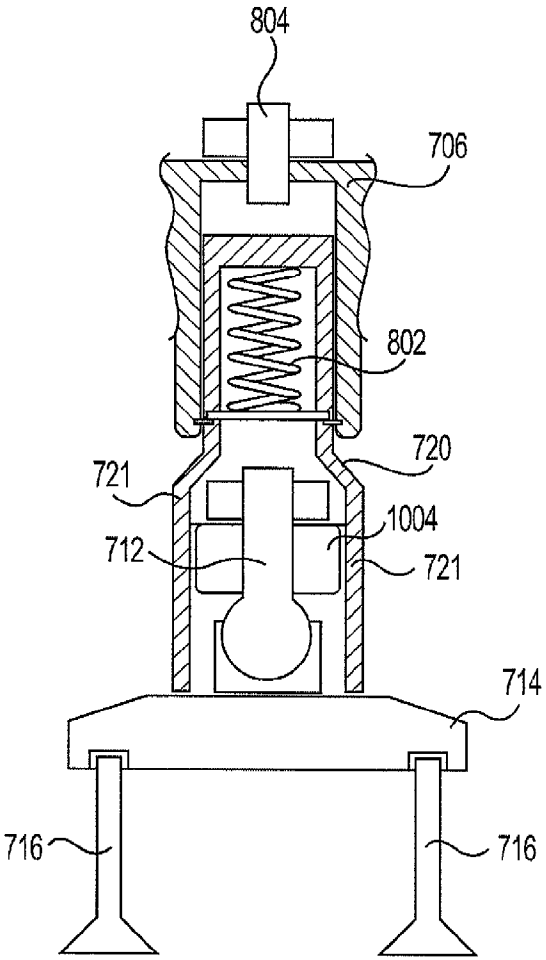
FIG. 7 is a schematic front view in partial cross-section of a of the variable valve actuation system of FIG. 6 that illustrates contact by the full rocker arm and a forked slave piston with a valve bridge.

The slave piston 720 shown in FIG. 6 may be designed as illustrated in FIG. 7, for example. With reference to FIG. 7, the slave piston 720 may include two forks 721 which may extend downward from the slave piston on either side of the valve end 1004 of the first rocker arm 1002 and into contact with the valve bridge 714. The forked slave piston 720 may apply valve actuation motions for compression release engine braking, early exhaust valve opening, and/or brake gas recirculation, for example, without interfering with and independent of the operation of the first rocker arm 1002.

Figure 8:
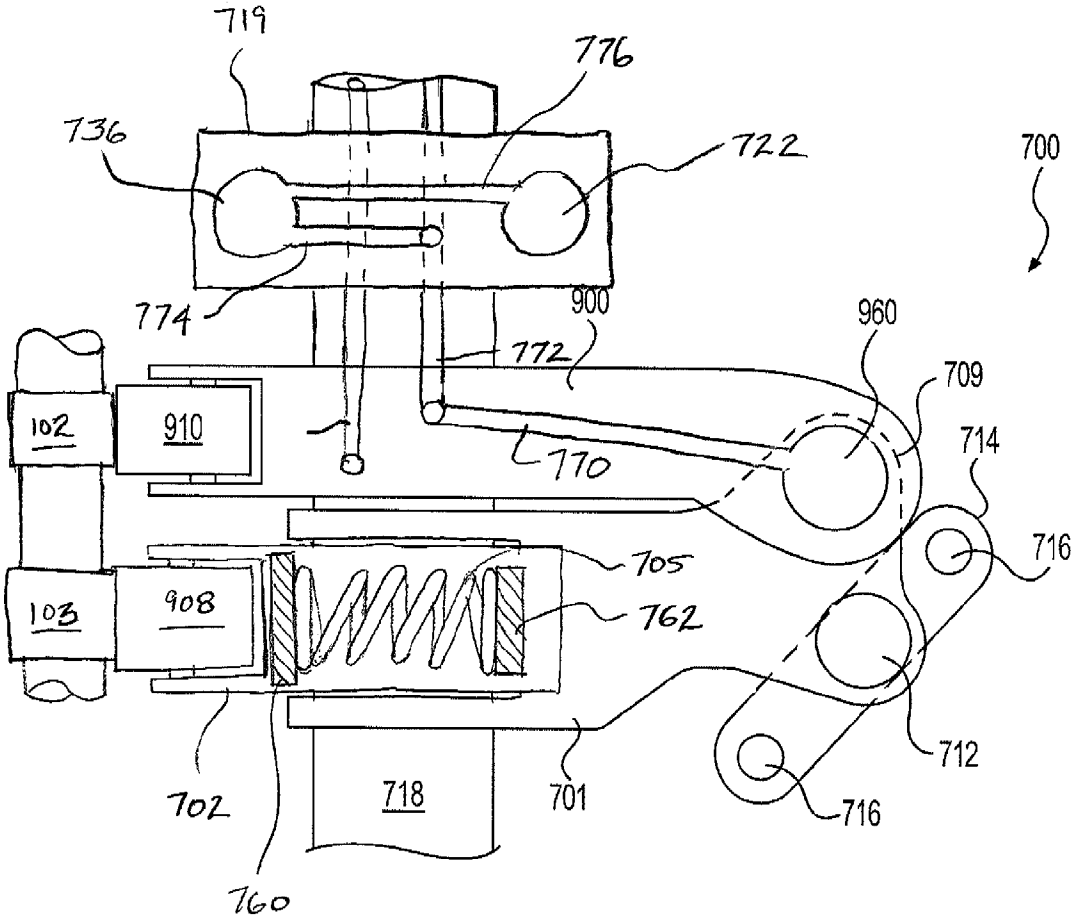
FIG. 8 is a schematic top view in partial cross-section of a half rocker arm which includes a flange for contact with either a slave piston or actuator piston in accordance with an alternative embodiment of the present invention.
Figure 10:
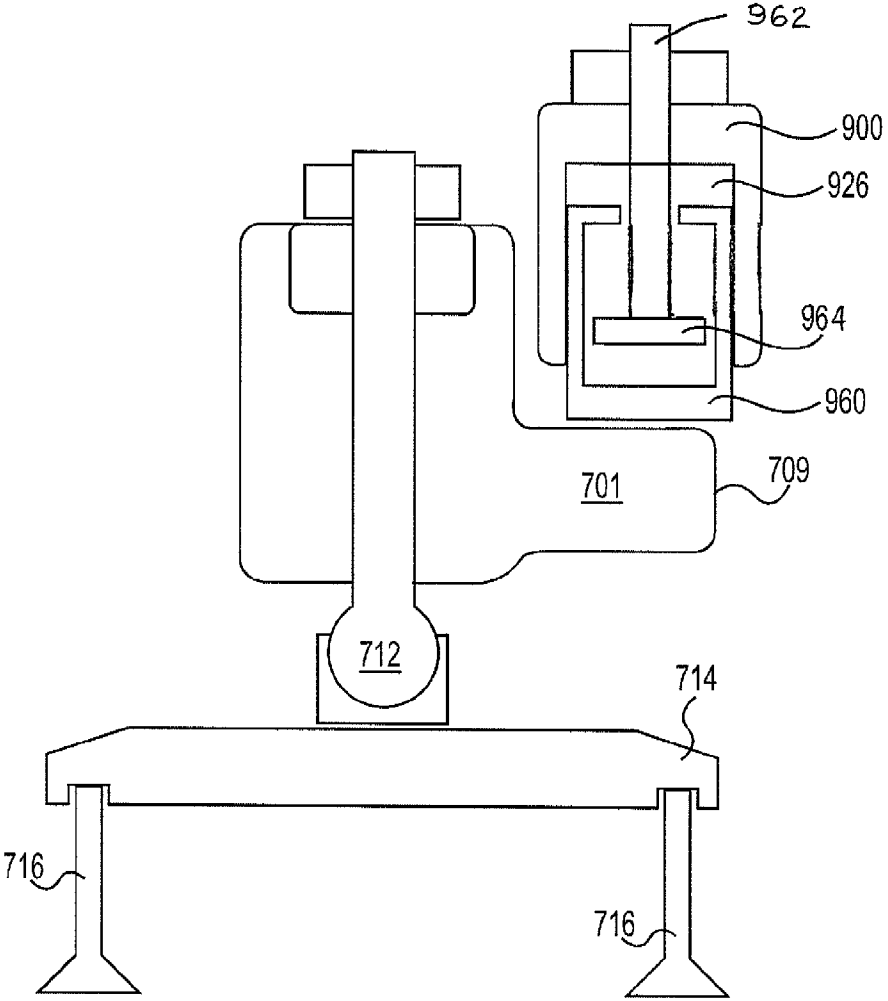
FIG. 10 is a schematic front view in partial cross-section of the half rocker arm shown in FIG. 8 with an actuator piston positioned above the half rocker arm flange.

Further variable valve actuation system embodiments of the present invention are illustrated by FIGS. 8-12. With reference to FIGS. 8 and 10, in a fourth embodiment of the present invention, the first valve train assembly of the variable valve actuation system 700 may include a first half rocker arm 701 pivotally disposed on a rocker shaft 718, similar to that described in connection with FIG. 3. The first half rocker arm 701 may be acted upon by a second half rocker arm (702 in FIG. 8) to provide a main exhaust valve event in the same manner as the system described in connection with FIG. 3. The first half rocker arm 701 may include a valve-side end with an elephant foot or other contact surface 712 adapted to provide exhaust valve actuation motion for exhaust valves 716 through a valve bridge 714. The first half rocker arm 701 may further include a side flange 709 which is adapted to receive exhaust valve actuation motion from a lost motion rocker arm.

With continued reference to FIG. 8 and in connection with the fourth embodiment of the present invention, the second valve train assembly of the variable valve actuation system 700 may include a lost motion rocker arm 900 pivotally mounted on the rocker shaft 718 adjacent to the first half rocker arm 701. The lost motion rocker arm 900 may include a cam roller 910 adapted to receive exhaust valve actuation motions from a first motion imparting means 102 which may provide valve actuation motions such as those required for a compression release engine braking event, an early exhaust valve opening event, and a brake gas recirculation event. The lost motion rocker arm 900 may be biased toward the first motion imparting means 102 by a spring 972 (shown in FIG. 11) which may create such bias force by pushing against a flange or contact surface 970 provided on the lost motion rocker arm from a fixed stop or flange 974 provided on a fixed engine part so that cam roller 910 may remain in relatively constant contact with the first motion imparting means 102. A hydraulic actuator piston 960 may be provided in one end of the lost motion rocker arm 900. The hydraulic actuator piston 960 may be selectively extended to engage a side flange 709 provided on the first half rocker arm 701. A hydraulic circuit may be provided in the lost motion rocker arm 900 so that hydraulic fluid may be selectively supplied to and drained from the hydraulic actuator piston 960. The hydraulic circuit may include a first hydraulic passage 770 connecting the hydraulic actuator piston 960 with the high-speed trigger valve 736 located in the adjacent rocker shaft pedestal 719 via hydraulic passages 772 and 774 provided in the rocker shaft 718 and rocker shaft pedestal, respectively. In turn, the trigger valve 736 may be connected to the accumulator 722 via a hydraulic passage 776.

The hydraulic actuator piston 960 may be slidably disposed within a bore in the lost motion rocker arm 900. The hydraulic actuator piston 960 may be sized to slide within its bore 926 while maintaining a relatively secure hydraulic seal with the wall of its bore. A vertically adjustable lash member or screw 962 (see FIG. 10) may be slidably received within the actuator piston 960. The stroke of the hydraulic actuator piston 960 may be limited by contact with a stop 964 on lash member 962 to provide travel slightly greater than the maximum valve lift due to the first motion imparting means 102.

Figure 11:
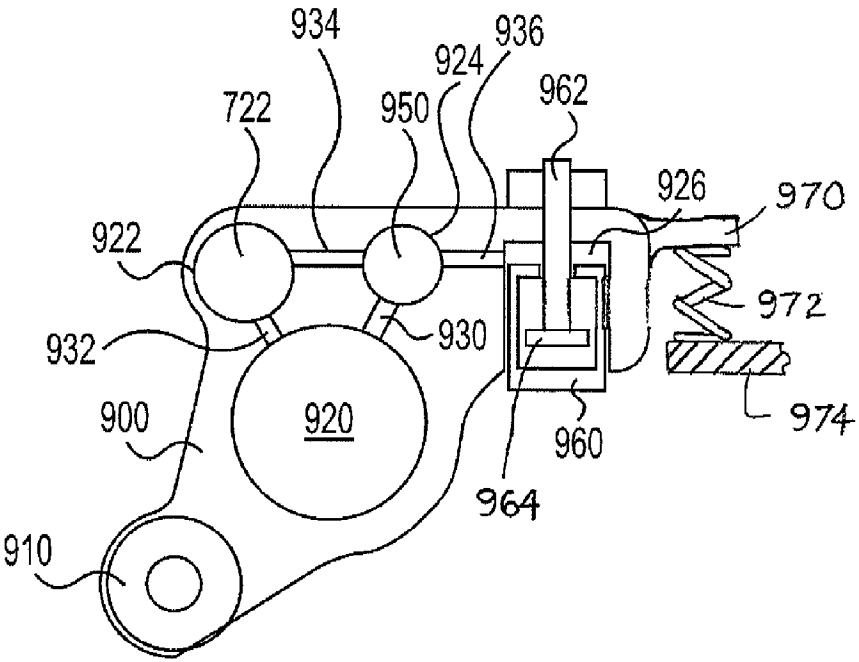
FIG. 11 is a schematic side view in partial cross-section of a rocker arm that includes an actuator piston such as shown in FIG. 10 which may be used in conjunction with the half rocker arm shown in FIG. 8

With reference to FIGS. 10 and 11, in a fifth embodiment of the present invention, the lost motion rocker arm 900 may include a central opening 920 for receipt of the rocker shaft, a first bore 922 for receipt of an accumulator 722, a second bore 924 for receipt of a control valve 950, and a third bore 926 for receipt of a hydraulic actuator piston 960 with a stop 964 to limit the maximum stroke of the hydraulic actuator piston. A hydraulic circuit may be provided in the full rocker arm 900. The hydraulic circuit may include a first passage 930 connecting the central opening 920 with the second bore 924, a second passage 932 connecting the central opening 920 with the first bore 922, a third passage 934 connecting the first bore 922 with the second bore 924, and a fourth passage 936 connecting the second bore 924 with the third bore 926. As a result of the hydraulic circuit, hydraulic fluid that may be provided to the central opening from one or more hydraulic fluid passages (not shown) in the rocker shaft 718 may be provided to the accumulator 722, the control valve 950 and the hydraulic actuator piston 960.

The hydraulic actuator piston 960 may be slidably disposed within the third bore 926. The hydraulic actuator piston 960 may be sized to slide within the third bore 926 while maintaining a relatively secure hydraulic seal with the wall of the third bore. A vertically adjustable lash member or screw 962 may be slidably received within the actuator piston 960 with a stop 964 to limit the maximum stroke of the hydraulic actuator piston.

The lost motion rocker arms 900 shown in both FIGS. 8 and 11 may act on the flange 709 shown in FIG. 10 to transfer valve actuation motion through the first half rocker arm 701 to one or more engine valves 716.

Figure 12:
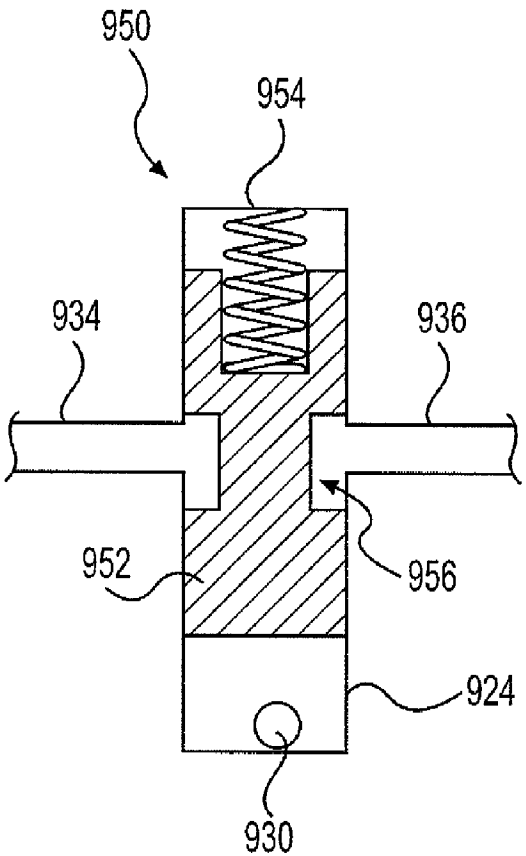
FIG. 12 is a schematic top view in partial cross-section of a shuttle valve which may be used in the rocker arm shown in FIG. 11.

An example of the control valve described above in connection with FIG. 11 is illustrated in FIG. 12. With reference to FIG. 12, the control valve 950 may include a control valve piston 952 and a control valve spring 954 which biases the control valve piston into the second bore 924. The second bore 924 in which the control valve piston is disposed may be connected with the first, third and fourth passages 930, 934 and 936, respectively. The selective supply of hydraulic fluid to the first passage 930 may cause the control valve piston 952 to shuttle back towards the spring 954 so that an annular recess 956 in the control valve piston places the third passage 934 in hydraulic communication with the fourth passage 936. Thus, selective supply of hydraulic fluid by a high-speed trigger valve to the first passage 930 can be used to selectively provide hydraulic fluid from the accumulator 722 to the actuator piston 960 and/or to selectively drain hydraulic fluid from the actuator piston 960 to the accumulator 722. When hydraulic fluid pressure is decreased in the first passage 930, the control valve piston 952 may be forced towards the first passage by the spring 954 so that the hydraulic fluid communication between the third and fourth passages 934 and 936 is cut off and the actuator piston 960 is hydraulically locked into a fixed position.

The interaction of the second half rocker arm 702 and the first half rocker arm 701 is illustrated by reference to FIGS. 8, 10 and 11. A spring may bias the second half rocker arm 702 away from the first half rocker arm 701 and into contact with the second motion imparting means 103. When the second motion imparting means 103 provides a valve actuation motion, such as a main exhaust event actuation, to the second half rocker arm 702, the second half rocker arm may, in turn, act on the first half rocker arm 701 to actuate the exhaust valves 716 for a main exhaust event. Because the first half rocker arm 701 is free to pivot away from the second half rocker arm, the full rocker arm 900 may also act on the first half rocker arm 701 through the flange 709 to provide valve actuation events such as compression release engine braking, brake gas recirculation, and/or early exhaust valve opening independent of the pivoting of the second half rocker arm.

The interaction of the full rocker arm 900, the hydraulic actuator piston 960 and the first half rocker arm 701 is illustrated by reference to FIGS. 8, 10-12. A spring 972 may bias the full rocker arm 900 into contact with the first motion imparting means 102. As shown in FIGS. 11 and 12, a control valve 950, which may operate under the control of a high-speed solenoid trigger valve (not shown) may be provided in the hydraulic circuit including passages 930, 932, 934 and 936 such that the control valve may control the supply of hydraulic fluid to and from the actuator piston 960. Further, the accumulator 722 may include an accumulator piston spring 724 (FIG. 4) that biases an accumulator piston 726 (FIG. 4) into an accumulator bore. When the control valve 950 is maintained closed, hydraulic fluid may be trapped in the third bore 926 so that the actuator piston 960 is prevented from being pushed into the third bore. Conversely, when the control valve 950 is maintained open, hydraulic fluid may flow freely out of the third bore 926 and into and out of the accumulator 722. When the control valve 950 is maintained open and the first motion imparting means 102 (FIG. 8) causes the full rocker arm 900 to pivot about the rocker shaft 718, the actuator piston 960 is forced against the flange 709. Because the control valve 950 is open, however, the actuator piston 960 is forced into the third bore 926 and the hydraulic fluid in the third bore is pushed back in the hydraulic circuit and absorbed by the accumulator 722. When the control valve 950 is closed, however, and the first motion imparting means 102 (FIG. 3) causes the full rocker arm 900 to pivot about the rocker shaft 718, the actuator piston 960 is hydraulically locked into position and the motion from the motion imparting means is transferred through the actuator piston to the flange 709 and from the flange to the first half rocker arm 701. In turn the half rocker arm 701 may act through the valve bridge 714 to actuate or open the exhaust valves 716. Use of the first motion imparting means 102, such as a cam with a compression release engine braking lobe, an early exhaust valve opening lobe, and/or a brake gas recirculation lobe, coupled with selective operation of the control valve 950 may enable selective provision of compression release engine braking and brake gas recirculation during an engine braking mode of engine operation and variable degrees of early exhaust valve opening during a positive power mode of engine operation.

Figure 9:
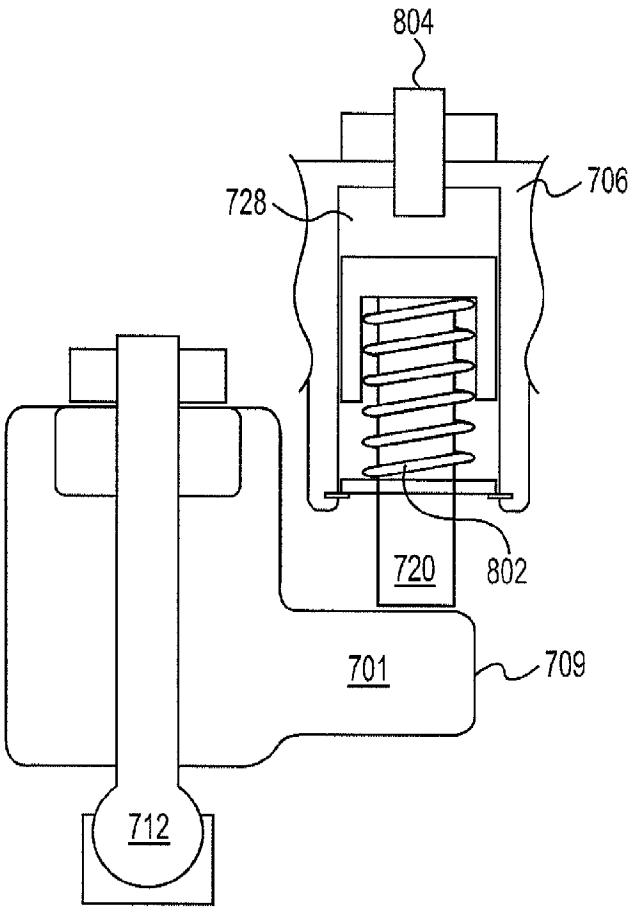
FIG. 9 is a schematic front view in partial cross-section of the half rocker arm shown in FIG. 8 with a slave piston positioned above the half rocker arm flange.

The sixth embodiment of the present invention consists of a variation of the second embodiment wherein the fixed housing lost motion system 706 described in connection with FIGS. 3-5 is substituted for the lost motion rocker arm 900 described above. The sixth embodiment is illustrated in FIG. 9, in which like reference characters correspond to like elements described in connection with the foregoing embodiments. In the sixth embodiment of the present invention, the slave piston 720 may selectively provide exhaust valve actuation motions, such as those for a compression release engine braking event, an early exhaust valve opening event, and/or a brake gas recirculation event to a side flange 709 extending from the side of the first half rocker arm 701, as shown in FIG. 9.

Figure 13:
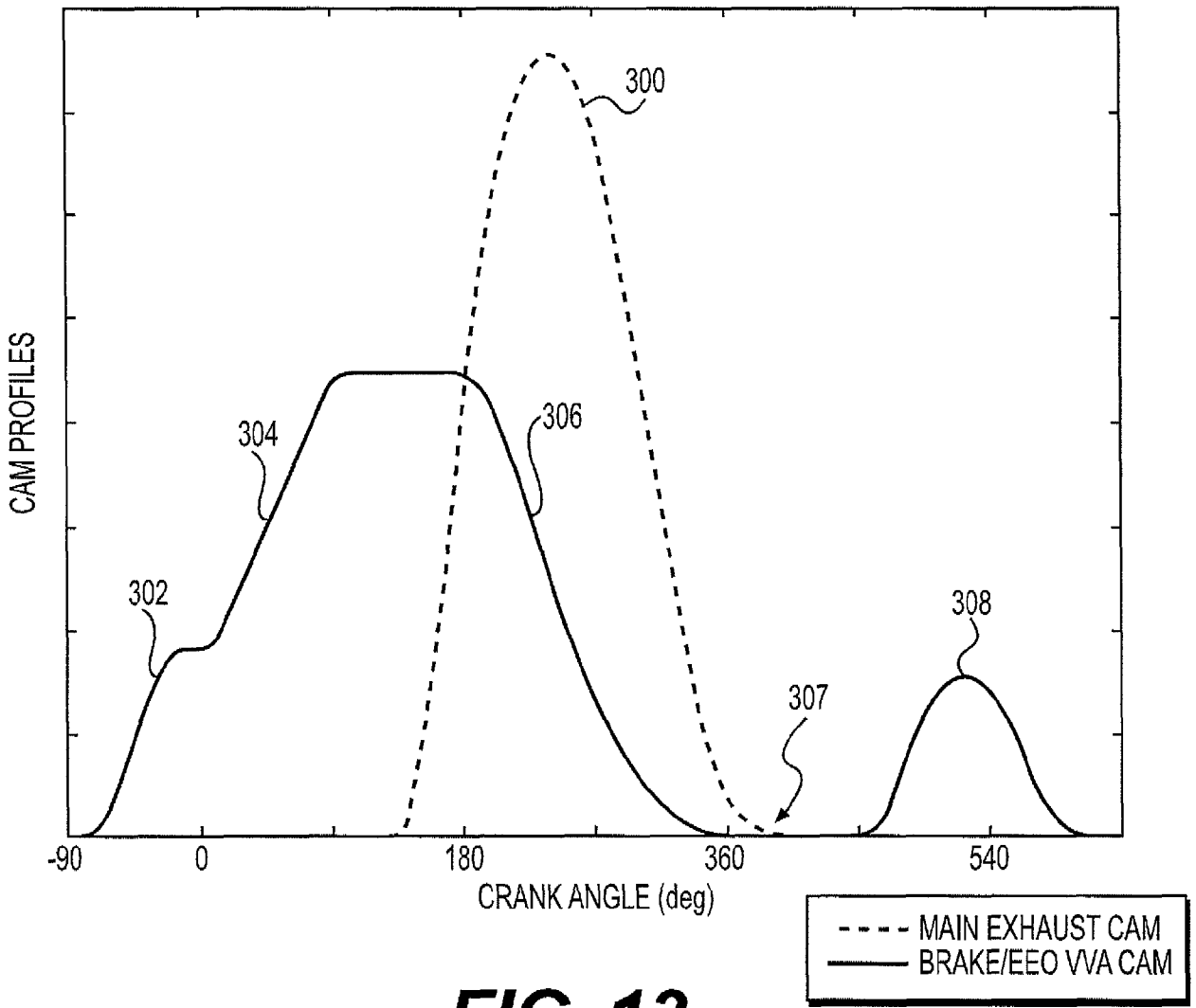
FIG. 13 illustrates the cam lift profiles of a main exhaust cam and an auxiliary cam with a compression-release/EEO lobe and a BGR lobe in accordance with an embodiment of the present invention.

FIG. 13 illustrates a first cam profile 302, 304, 306 and 308 corresponding to the lobes on the cam 200, and a second cam profile 300 with a main exhaust lobe. The first cam profile may be used to provide the first motion imparting means with one or more auxiliary exhaust valve actuation motions and the second cam profile may be used to provide the second motion imparting means with a main exhaust valve actuation motion. In a preferred embodiment, the cam 200 may include a compression release lobe 302, an early exhaust valve opening lobe 304 with a closing ramp 306, and a brake gas recirculation lobe 308. The first cam profile in FIG. 3 may include, starting from the left, the compression release lobe 302 leading into the early exhaust valve opening lobe 304, followed by a flat cam segment and a closing ramp 306 which meets the cam base circle 307 before the end of the main exhaust cam lobe 300. The first cam profile may further include a brake gas recirculation (BGR) or exhaust gas recirculation (EGR) lobe 308.

Figure 14:
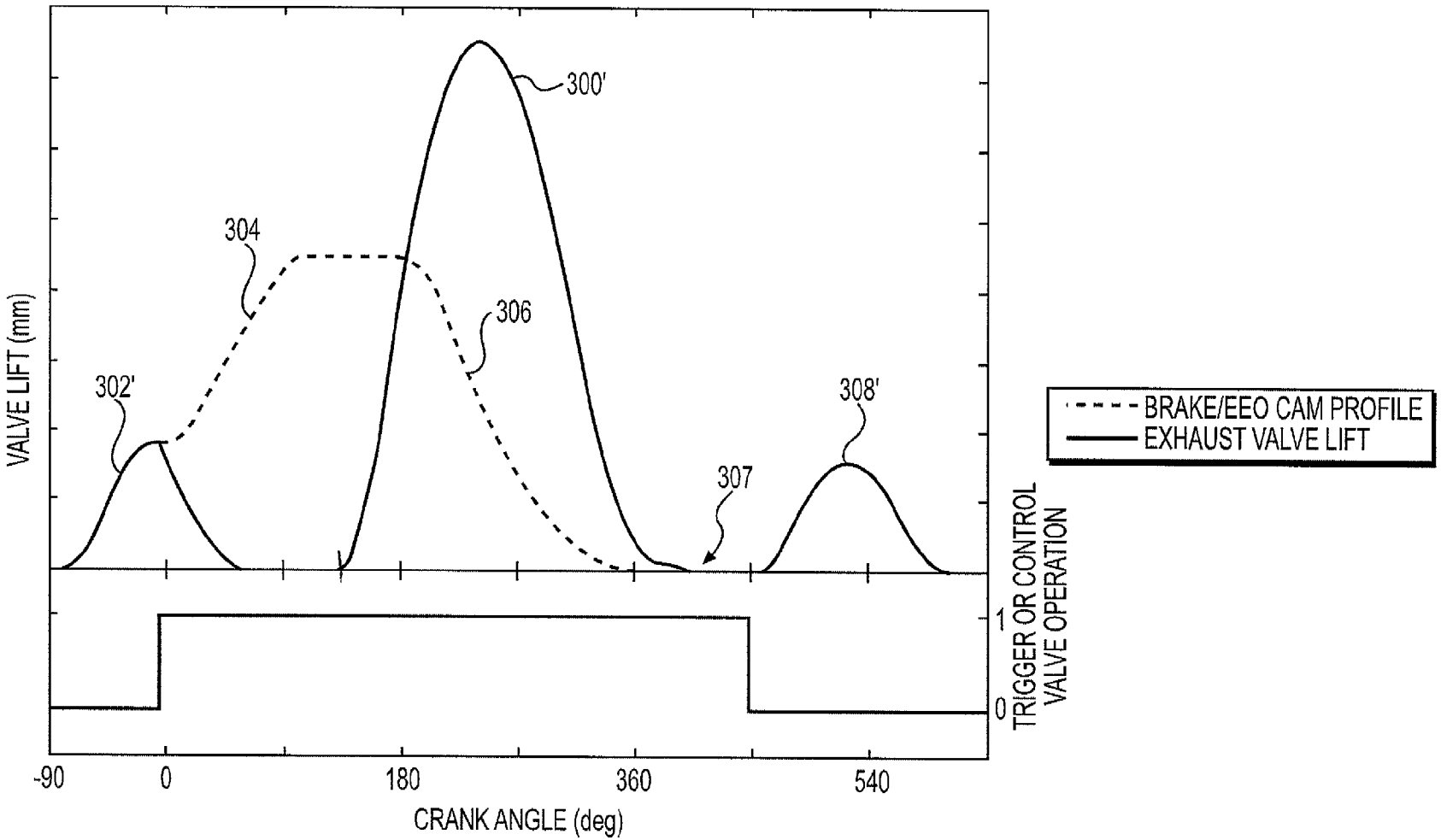
FIG. 14 illustrates the compression-release, main exhaust, and BGR exhaust valve lifts that may be obtained using the cam lobe profiles of FIG. 13 with a lost motion system and specified trigger valve operation in accordance with an embodiment of the present invention.
Figure 15:
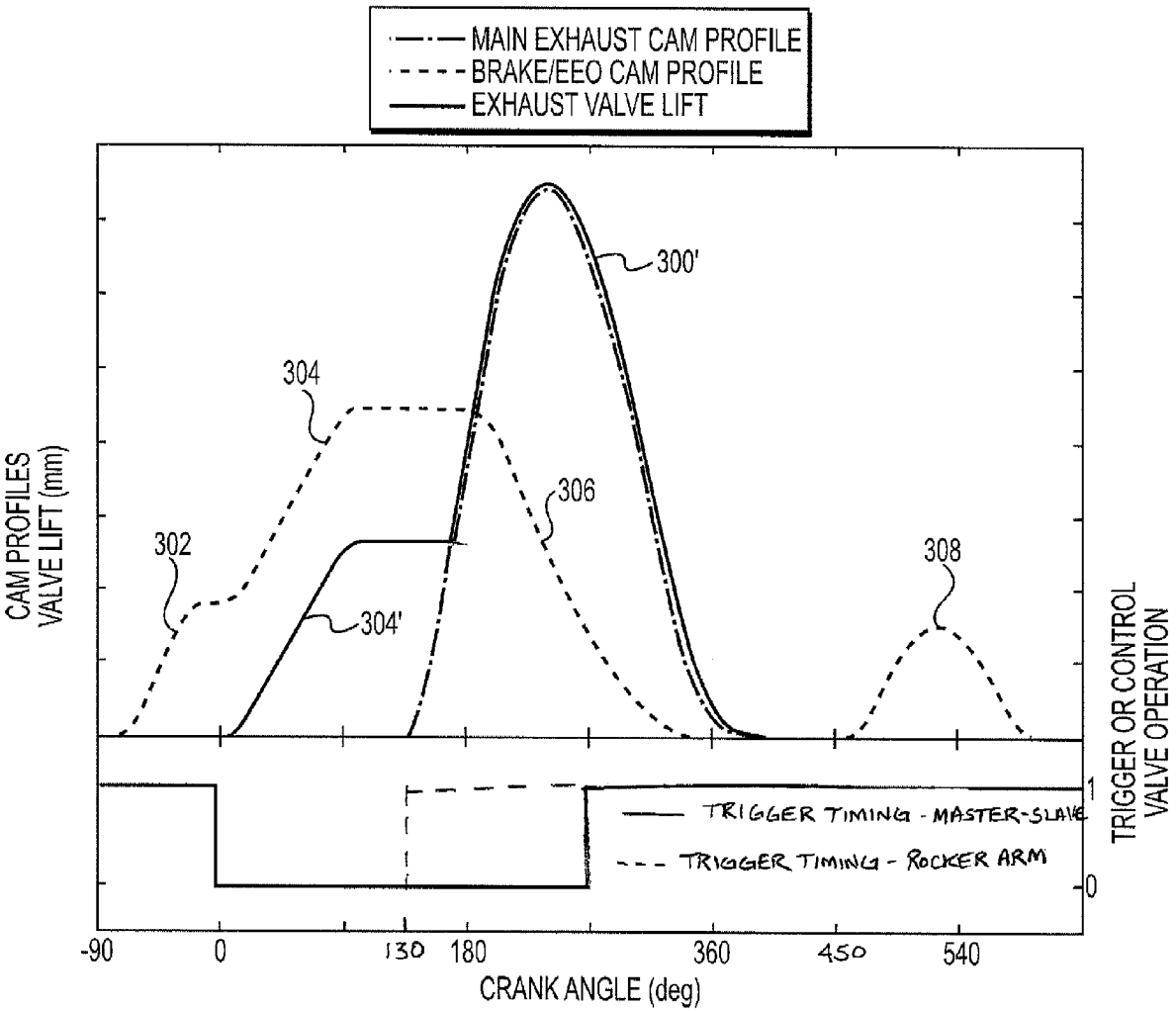
FIG. 15 illustrates the early exhaust valve opening and the main exhaust valve lifts that may be obtained using the cam lobe profiles of FIG. 13 with a lost motion system and a second specified trigger valve operation in accordance with an embodiment of the present invention.
Figure 16:
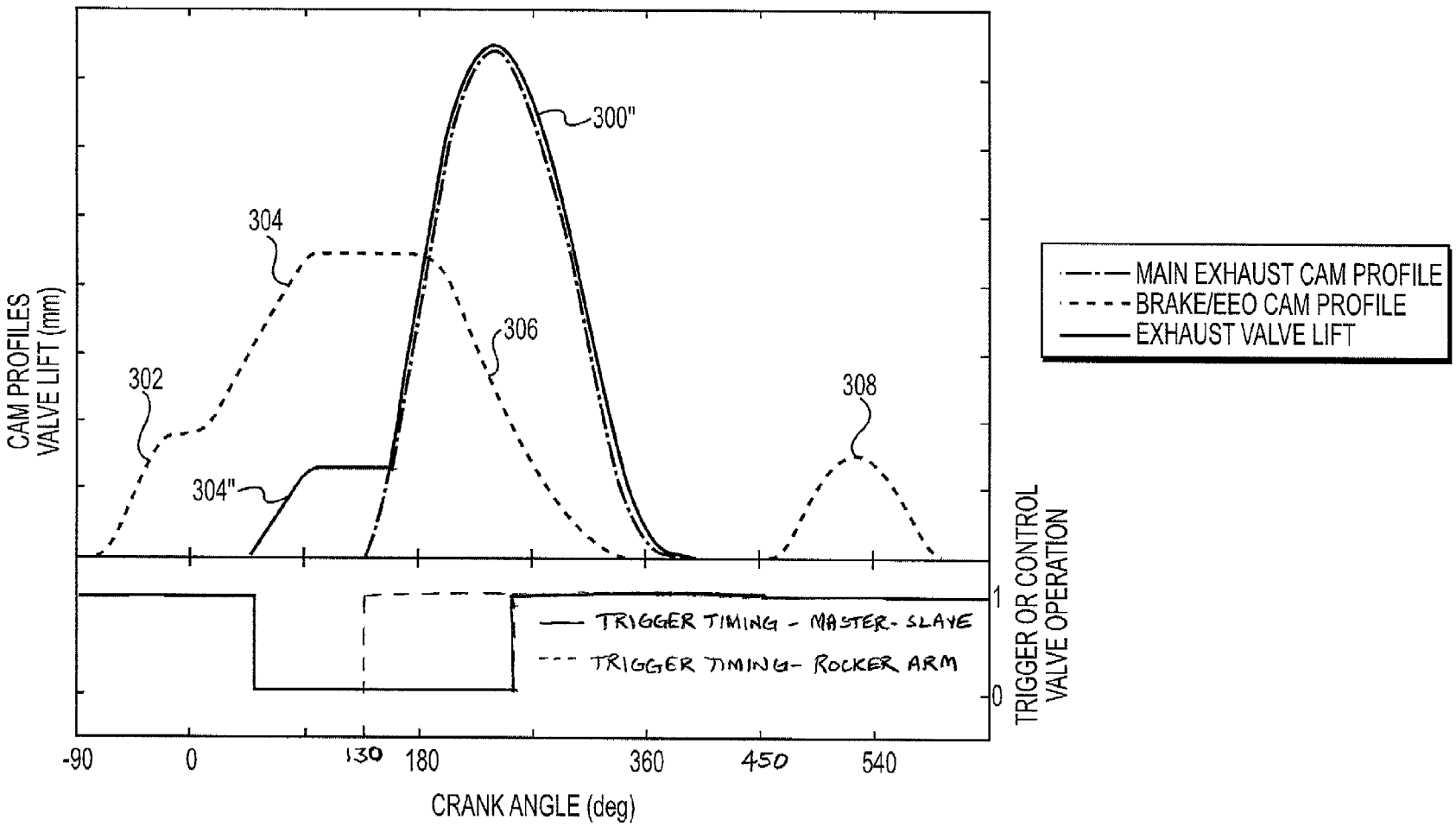
FIG. 16 illustrates the early exhaust valve opening and the main exhaust valve lifts that may be obtained using the cam lobe profiles of FIG. 13 with a lost motion system and a third specified trigger valve operation in accordance with an embodiment of the present invention.

FIGS. 14-16 illustrate the exhaust valve lifts that may be provided using the first and second cam profiles illustrated in FIG. 13 in combination with the variable valve actuation systems described in connection with FIGS. 1 and 3-12 which may selectively transfer motion from the cam 200 to the exhaust valve(s). The trigger valve or control valve operation to provide three different sets of exhaust valve actuations are also illustrated in FIGS. 14-16. In FIGS. 14-16, a state of "0"

indicates that the trigger or control valve is closed and the lost motion master-slave system (FIGS. 3-7 and 9) or the lost motion rocker arm system (FIGS. 8 and 10-12) is in a state in which valve actuation motion is transferred to the exhaust valves from the first motion imparting means. A state of "1" indicates that the trigger or control valve is open and the lost motion master-slave system or the lost motion rocker arm system is in a state in which the valve actuation motion applied by the first motion imparting means is absorbed.

With reference to FIG. 14, during an engine braking mode of engine operation and when the trigger or control valve is initially in state "0", or closed, the lost motion master-slave or rocker arm system may transfer motion from the compression release cam lobe 302 (FIG. 13) to produce a compression release valve event 302'. When the compression release valve event is completed, at about (0) crank angle degrees (i.e., top dead center compression) the trigger or control valve may be opened to release hydraulic pressure in the master-slave circuit or actuator piston and close the exhaust valves. Thereafter the exhaust valves may be opened for the main exhaust event 300' by the second motion imparting means. At about (450) crank angle degrees (i.e., after the end of cam segment 306) the trigger or control valve may be closed again so that the lost motion master-slave or rocker arm system may transfer motion from the brake gas recirculation lobe 308 (FIG. 13) to produce a brake gas recirculation valve event 308'. Refill of the lost motion hydraulic circuit may occur between about (130) and (450) crank angle degrees, depending on whether a master-slave system or a rocker arm system is being used.

With reference to FIG. 15, during a first positive power mode of engine operation and when the trigger or control valve is initially in state "1", or open, the lost motion master-slave or rocker arm system may absorb the motion received from the compression release cam lobe 302 (FIG. 13) of the first motion imparting means so that the exhaust valves remain initially closed. After the compression release cam lobe is passed, at about (0) crank angle degrees the trigger or control valve may be closed so that the lost motion master-slave or rocker arm system may transfer motion from the early exhaust valve opening lobe 304 (FIG. 13) to produce an early exhaust valve opening event 304'. Thereafter, the main exhaust valve motion from the second motion imparting means may take over to provide the remainder of the actuation required for the main exhaust valve event 300'. After about (130) or about (270) crank angle degrees, depending on whether a master-slave or rocker arm system is used, the trigger or control valve may be opened again for hydraulic circuit refill so that the lost motion master-slave or rocker arm system may absorb the motion from the brake gas recirculation lobe 308 (FIG. 13) of the first motion imparting means.

With reference to FIG. 16, during a second positive power mode of engine operation and when the trigger or control valve is initially in state "1", or open, the lost motion master-slave or rocker arm system may absorb the motion received from the compression release cam lobe 302 (FIG. 13) of the first motion imparting means so that the exhaust valves remain initially closed. After the compression release cam lobe is passed, at about (45) crank angle degrees the trigger or control valve may be closed so that the lost motion master-slave or rocker arm system may transfer motion from the early exhaust valve opening lobe 304 (FIG. 13) to produce an abbreviated early exhaust valve opening event 304". Thereafter, the main exhaust valve motion from the second motion imparting means may take over to provide the remainder of the actuation required for the main exhaust valve event 300". After about (130) or about (270) crank angle degrees, depending on whether a master-slave or rocker arm system is used, the trigger or control valve may be opened again for hydraulic circuit refill and so that the lost motion master-slave or rocker arm system may absorb the motion from the brake gas recirculation lobe 308 (FIG. 13) of the first motion imparting means.

Embodiments of the present invention may have many advantages, including providing variable engine braking, brake gas recirculation, and variable early exhaust valve opening for exhaust gas temperature control for emissions after-treatment and/or turbo stimulation for improved transient torque. Additional advantages may include a mechanically-driven exhaust main event for cold start and failsafe, meeting loading limits, especially cam Hertz stress, avoiding separation and impact loading between cams and rollers, avoiding valve bridge tilt, meeting exhaust valve seating velocity limits, and protecting against valve-piston contact.

It will be apparent to those skilled in the art that variations and modifications of the present invention can be made without departing from the scope or spirit of the invention. For example, it is appreciated that selective control of the trigger valve or control valve operation may produce engine valve actuations with timing other than those illustrated in FIGS. 14-16. Further, it is appreciated that the variable valve actuation systems described in connection with FIGS. 1-12 may be used to actuate not only exhaust valves, but also intake and/or auxiliary engine valves. Thus, it is intended that the present invention cover all such modifications and variations of the invention, provided they come within the scope of the appended claims and their equivalents.

What is claimed is:

1. A system for actuating an internal combustion engine exhaust valve to provide compression release actuation during an engine braking mode of engine operation and early exhaust valve opening actuation during a positive power mode of engine operation, said system comprising:

a first cam having a compression release lobe and an early exhaust valve opening lobe;

a hydraulic lost motion system operatively contacting said first cam, said hydraulic lost motion system including a first rocker arm;

a hydraulically actuated piston extending from said hydraulic lost motion system, said hydraulically actuated piston adapted to provide said exhaust valve with compression release actuation during an engine braking mode of engine operation and early exhaust valve opening actuation during a positive power mode of operation;

a second cam having a main exhaust lobe; and a main exhaust rocker arm operatively contacting said second cam and adapted to provide a main exhaust actuation to said exhaust valve.

2. The system of claim 1, wherein the main exhaust rocker arm comprises a first half rocker arm operatively contacting the second cam and a second half rocker arm operatively contacting the first half rocker arm.

3. The system of claim 2, further comprising a means for biasing the first half rocker arm into contact with the second cam.

4. The system of claim 1, wherein the hydraulically actuated piston is a slave piston, and wherein the hydraulic lost motion system further comprises:

a master piston provided in said hydraulic lost motion system; and a hydraulic circuit connecting said master piston and said slave piston.

5. The system of claim 4, further comprising a trigger valve disposed in the hydraulic circuit between the master piston and the slave piston.

6. The system of claim 5, further comprising a hydraulic fluid accumulator communicating with said hydraulic circuit.

7. The system of claim 4, wherein the first rocker arm comprises a half rocker arm having a contact surface adapted to provide motion to said master piston.

8. The system of claim 7, wherein the hydraulic lost motion system is provided at least partially in a fixed housing relative to said internal combustion engine.

9. The system of claim 2, further comprising a side flange extending from said second half rocker arm.

10. The system of claim 9, wherein said hydraulic lost motion system comprises a hydraulic circuit disposed partially in said first rocker arm and partially in a rocker shaft pedestal adjacent to said first rocker arm.

11. The system of claim 10, wherein said hydraulically actuated piston is slidably disposed in said first rocker arm and further comprising a control valve disposed in the hydraulic circuit.

12. The system of claim 11, further comprising a hydraulic fluid accumulator communicating with said hydraulic circuit.

13. The system of claim 9, wherein said hydraulically actuated piston is slidably disposed in said first rocker arm and said hydraulic lost motion system comprises a hydraulic circuit disposed at least partially in said first rocker arm.

14. The system of claim 13, further comprising a hydraulic fluid control valve disposed in said first rocker arm, and wherein said hydraulic circuit extends between said hydraulic fluid control valve and said hydraulically actuated piston.

15. The system of claim 14, further comprising a hydraulic fluid accumulator disposed in said first rocker arm and communicating with said hydraulic circuit.

16. The system of claim 1 further comprising a means for controlling said hydraulic lost motion system to alternatively provide no exhaust valve actuation, compression release actuation during an engine braking mode of engine operation, and early exhaust valve opening actuation during a positive power mode of engine operation.

17. The system of claim 16, wherein the means for controlling said hydraulic lost motion system is also a means for varying the timing of early exhaust valve opening.

18. The system of claim 1, further comprising an exhaust gas recirculation lobe or brake gas recirculation lobe on said first cam.

19. The system of claim 18 further comprising a means for controlling said hydraulic lost motion system to alternatively provide no exhaust valve actuation, compression release actuation during an engine braking mode of engine operation, and early exhaust valve opening actuation with exhaust gas recirculation during a positive power mode of engine operation.

20. The system of claim 19, wherein the means for controlling said hydraulic lost motion system is also a means for varying the timing of early exhaust valve opening.

21. The system of claim 18 further comprising a means for controlling said hydraulic lost motion system to alternatively provide no exhaust valve actuation, compression release actuation with brake gas recirculation during an engine braking mode of engine operation, and early exhaust valve opening actuation during a positive power mode of engine operation.

22. The system of claim 21, wherein the means for controlling said hydraulic lost motion system is also a means for varying the timing of early exhaust valve opening.

23. A system for actuating an internal combustion engine exhaust valve comprising:

a first means for imparting motion for a compression release engine braking actuation and an early exhaust valve opening actuation;

a hydraulic lost motion system operatively contacting said first means for imparting motion, said hydraulic lost motion system including a first rocker arm;

a hydraulically actuated piston extending from said hydraulic lost motion system, said hydraulically actuated piston adapted to selectively provide said exhaust valve with compression release engine braking actuation and early exhaust valve opening actuation;

a second means for imparting motion for a main exhaust actuation;

a main exhaust rocker arm operatively contacting said second means for imparting motion; and means for controlling said hydraulic lost motion system to selectively provide the compression release engine braking actuation and the early exhaust valve opening actuation.

24. The system of claim 23, wherein said first means for imparting motion further comprises means for imparting motion for a brake gas recirculation actuation.

25. The system of claim 23, wherein said first means for imparting motion further comprises means for imparting motion for an exhaust gas recirculation actuation.

26. A method of actuating an internal combustion engine exhaust valve to alternatively provide compression release engine braking actuation and early exhaust valve opening actuation using a cam with a compression release engine braking lobe and a early exhaust valve opening lobe, said method comprising:

imparting compression release engine braking actuation motion and early exhaust valve opening actuation motion from said cam to a hydraulic lost motion system including a first rocker arm;

determining whether the internal combustion engine is in an engine braking mode of operation;

selectively hydraulically locking and unlocking a hydraulically actuated piston in said hydraulic lost motion system to provide said exhaust valve with compression release engine braking actuation when the internal combustion engine is in the engine braking mode of operation;

determining whether the internal combustion engine is in a positive power mode of operation and early exhaust valve opening is desired; and selectively hydraulically locking and unlocking the hydraulically actuated piston in said hydraulic lost motion system to provide said exhaust valve with early exhaust valve opening actuation when the internal combustion engine is in the positive power mode of operation and early exhaust valve opening is desired.

27. The method of claim 26, further comprising the steps of:

imparting a brake gas recirculation actuation from said cam to said hydraulic lost motion system; and selectively hydraulically locking and unlocking the hydraulically actuated piston in said hydraulic lost motion system to provide said exhaust valve with brake gas recirculation actuation when the internal combustion engine is in the engine braking mode of operation.

28. The method of claim 26, further comprising the steps of:

imparting an exhaust gas recirculation actuation from said cam to said hydraulic lost motion system; and selectively hydraulically locking and unlocking the hydraulically actuated piston in said hydraulic lost motion system to provide said exhaust valve with exhaust gas recirculation when the internal combustion engine is in the positive power mode of operation.

29. The method of claim 26, further comprising the steps of:

imparting a brake gas recirculation actuation from said cam to said hydraulic lost motion system;

selectively hydraulically locking and unlocking the hydraulically actuated piston in said hydraulic lost motion system to provide said exhaust valve with brake gas recirculation actuation when the internal combustion engine is in the engine braking mode of operation;

imparting an exhaust gas recirculation actuation from said cam to said hydraulic lost motion system; and selectively hydraulically locking and unlocking the hydraulically actuated piston in said hydraulic lost motion system to provide said exhaust valve with exhaust gas recirculation when the internal combustion engine is in the positive power mode of operation.

30. The method of claim 26 wherein said hydraulically actuated piston is a slave piston in a master-slave piston circuit.

31. The method of claim 26 wherein said hydraulically actuated piston is slidably disposed in said first rocker arm.

* * * * *